US008733758B2

(12) United States Patent
Chodniewicz

(10) Patent No.: US 8,733,758 B2
(45) Date of Patent: May 27, 2014

(54) POKER BASED PUZZLE AND METHOD OF CREATION

(76) Inventor: David Chodniewicz, Washington, DC (US)

( * ) Notice: Subject to any disclaimer, the term of this patent is extended or adjusted under 35 U.S.C. 154(b) by 372 days.

(21) Appl. No.: 12/835,287

(22) Filed: Jul. 13, 2010

(65) Prior Publication Data

US 2012/0013074 A1 Jan. 19, 2012

(51) Int. Cl.
*A63F 3/06* (2006.01)

(52) U.S. Cl.
USPC ..... 273/274

(58) Field of Classification Search
USPC ..... 273/274, 292; 463/12, 13
See application file for complete search history.

(56) References Cited

U.S. PATENT DOCUMENTS

| | | | | |
|---|---|---|---|---|
| 7,481,432 | B2 * | 1/2009 | Feola | 273/139 |
| 7,874,902 | B2 * | 1/2011 | Pullman | 463/13 |
| 2007/0018400 | A1 * | 1/2007 | Feola | 273/292 |

OTHER PUBLICATIONS

Duplicate Poker, http://en.wikipedia.org/wiki/Duplicate_poker, 2007.*

* cited by examiner

*Primary Examiner* — William Pierce
(74) *Attorney, Agent, or Firm* — James A. Italia; Italia IP

(57) ABSTRACT

A method of establishing one or more puzzles from candidate deals of a card game such as poker, for supporting an exercise in guessing an opponent's concealed card holdings. The method may use random dealing, archived actual deals, and other manufactured or sourced material to source an inventory of candidate deals. To qualify a deal from the inventory of candidate deals, the method may quantify one or more parameters of a candidate card deal. Quantified parameters may be weighted or otherwise mathematically treated, then evaluated to arrive at a determination of suitability for establishing a puzzle based on the candidate deal. The puzzles may be used as the basis of an exercise or game wherein the participant must guess the nature of concealed card holdings. Where the invention is regarded as the resultant game, guesses may be mathematically quantified to arrive at a score.

7 Claims, 4 Drawing Sheets

POKER BASED PUZZLE AND METHOD OF CREATION

FIELD OF THE INVENTION

The present invention relates to games, and more particularly to a game which is an exercise or puzzle based on a known card game in which elements of a previously played game have been concealed such that the purpose of the game is to have a game player learn to arrive at accurate guesses for the concealed elements of the game.

BACKGROUND OF THE INVENTION

It is well known that many card games, which are seemingly games of chance and in which success is seemingly dependent upon the power of cards dealt to a player, are actually games of skill. One of the primary skills of winning players in any card game is accurately assessing, or reading, opponents and extracting favorable outcomes from any given card holding or game situation by acting accordingly. In some games, this is done in conjunction with betting.

One such game is poker, a game which utilizes a deck of cards of which some are distributed to each player, with a goal of each player to identify any weaknesses in his or her opponent's card holdings or game play and extract maximum value, typically in the form of money or tokens such as chips, from opponents by exploiting those weaknesses. To do so, players may elect to bet, raise, call, fold, or check, and if entitled to, may adjust bet or raise sizes accordingly. Identifying the particular action that leads to an outcome of maximum value requires many poker skills, one of which requires players to make educated guesses as to the card holdings of his or her opponents. Because a player cannot see some or all of the cards held by his or her opponents, that player must, as all players must, draw inferential conclusions as to the power or standing of his or her opponents' card holdings, or range of card holdings, based on any information from the current deal or other information known about the opponent.

Further, an important aspect of poker is that of acting as though a player has a more powerful, or less powerful, holding than is actually the case. This is called bluffing. One of the requisite skills for poker players then is to be able to bluff when adventurous, or mathematically advantageous, and also to discern when other players may be bluffing. This exponentially increases the difficulty of discerning an opponent's card holdings, as an opponent may have a very strong holding yet act weak, or alternatively, an opponent may be holding weak cards yet act strong.

Developing an advanced ability to read poker players and poker situations, bet appropriately, bluff, and detect bluffing on the part of opponents at the table may be achieved by actual experience gained while playing poker. However, this may take a considerable amount of time, and may further entail risking money because of betting.

It is desirable then to find a way of accelerating the process of learning poker strategy and other aspects of poker playing, such as reading poker players and game situations, other than by actual play over a potentially long period of time and potentially at great financial expense. A game or training exercise which would enable players to learn poker strategy from actual games, about actual players, of real game situations encountered in live play without the risk of financial losses is highly desirable. In addressing such needs, this invention discloses a method of producing such training game exercises for a known card game such as poker.

SUMMARY OF THE INVENTION

In one aspect, the present invention provides a method of establishing at least one deal of a hand of a pre-established or known game such as poker such that the deal is suitable for a game in which a player attempts to guess the nature of concealed card holdings.

The present game may be established based on a recorded history of a previously played deal or on a manufactured deal of the pre-established game, or a game may be fabricated or manufactured to serve the purposes of the present invention. However, not all deals or game situations lend themselves advantageously to the novel game.

A deal of the pre-established game, which may or may not be suitable for the present game, may be obtained in any suitable way such as random deals, retrieval of historical compilations of actually dealt or played deals, by arbitrary selection or establishment of deals, by fabrication of manufacturing of deals, or by any combination of these. A further aspect of the invention then is a way to qualify or manufacture an appropriate game situation for incorporation into the present game. The present invention therefore provides a method of qualifying a deal from all available deals or manufacturing the present game so that the qualified deal or manufactured game is suitable for an exercise of the present game in which a player attempts to guess the nature of concealed card holdings of a player or players dealt into the original deal. This can be implemented by quantifying and assessing values of novel game parameters which are desirable to include and desirable to limit.

The present method preferably establishes a plurality of such games, so that a repetitious exercise is implemented wherein a player guesses the nature of concealed card holdings in many games. According to another aspect, the invention may be thought of as a game puzzle wherein the goal is to have a puzzle solver guess the nature of concealed card holdings by using the information established and provided by the novel method.

In utilizing the novel method to establish a deal of the present game, the present method dissects, measures, and evaluates novel attributes of a deal of a pre-established game such as poker to determine whether the deal is suitable for the present game. The subsequent game created based on such analyses requires a participant or player of the present game to solve the game by utilizing specific skills to analyze aspects of the original deal. These aspects may include for example, game and action progression, characteristics of the various players such as playing style or body language, historical statistics of the various players, any visible or known card holdings, and still other information which may be obtained and evaluated for use in the present game.

The present game therefore may reproduce an actual or synthesized game position taken from a known game such as poker, and present a player of the present game with the situation faced by a player of the original deal. The player of the present game may be required to solve the present game by assessing given game information and providing a guess as to the card holdings of a selected player or players of the original deal. A score may be assigned to the player of the present game, for example based on accuracy, or how close to the actual or synthesized outcome of the original deal the player of the present game has come in assessing the concealed holdings of the selected player or players of the original game.

There are at least two main uses for the invention. One is instructive, in that a participant may learn card playing skills, and in particular, the skill of reading card players and more accurately assessing the nature of concealed card holdings of a player or players in a card game. A second benefit is that of amusement derived from participation from an exercise based on the novel method.

In providing instruction, benefits of the present game include an expedited process of gaining experience and proficiency in the pre-established game. By generating a virtual game in which some of the play has been reproduced and presented to the participating player, delays inherent in actual play, such as lost time typically due to waiting for a game to begin or undue delays such as waiting for a succession of other players to decide on their respective courses of action, are eliminated and more deals may be completed in a given time window.

Further, deals of the present game may be presented in such a manner that specific skills are learned by grouping deals around a common game situation, specific game players or playing styles, game decisions, or other factors, to eliminate the study of deals which may be uneventful or unnecessary in training. Additionally, by analyzing game results of a participant in the present invention, the participant may rapidly self-identify specific areas of weakness and be presented with specialized game exercises focused on improving those areas of weakness.

A further benefit of establishing the novel game is cost savings to the participant or player of the present game. The present game provides a way for a person to play a game from within his or her residence, rather than being obliged to travel potentially a considerable distance to attend and learn from an actual game or other play venue. Further, by not requiring direct participation in the original game, players of the present game eliminate any potential risk of financial losses due to betting. Whether the participant seeks expedited, risk-free instruction, amusement, or both, the skill of accurately assessing an opponent's card holdings, and more particularly, concealed card holdings, becomes the focus of the present invention.

It is therefore an object of the invention to provide a way to qualify a deal of known or pre-established game or manufacturing a game, so that the qualified deal or manufactured game is suitable for an exercise wherein a participant must attempt to guess concealed card holdings of a player in the original deal.

Another object of the invention is to provide a player with game information, such that the provided information represents a real-life game scenario, and to place a player of the present game in a situation which immediately presents him or her with an exercise in making an assessment pertinent to the original game.

A further object is to expedite practice sessions applicable to a known game by eliminating delays inherent in actual play and restricting exercises to those which are appropriate for instruction in the original game.

DETAILED DESCRIPTION

Figure 1:
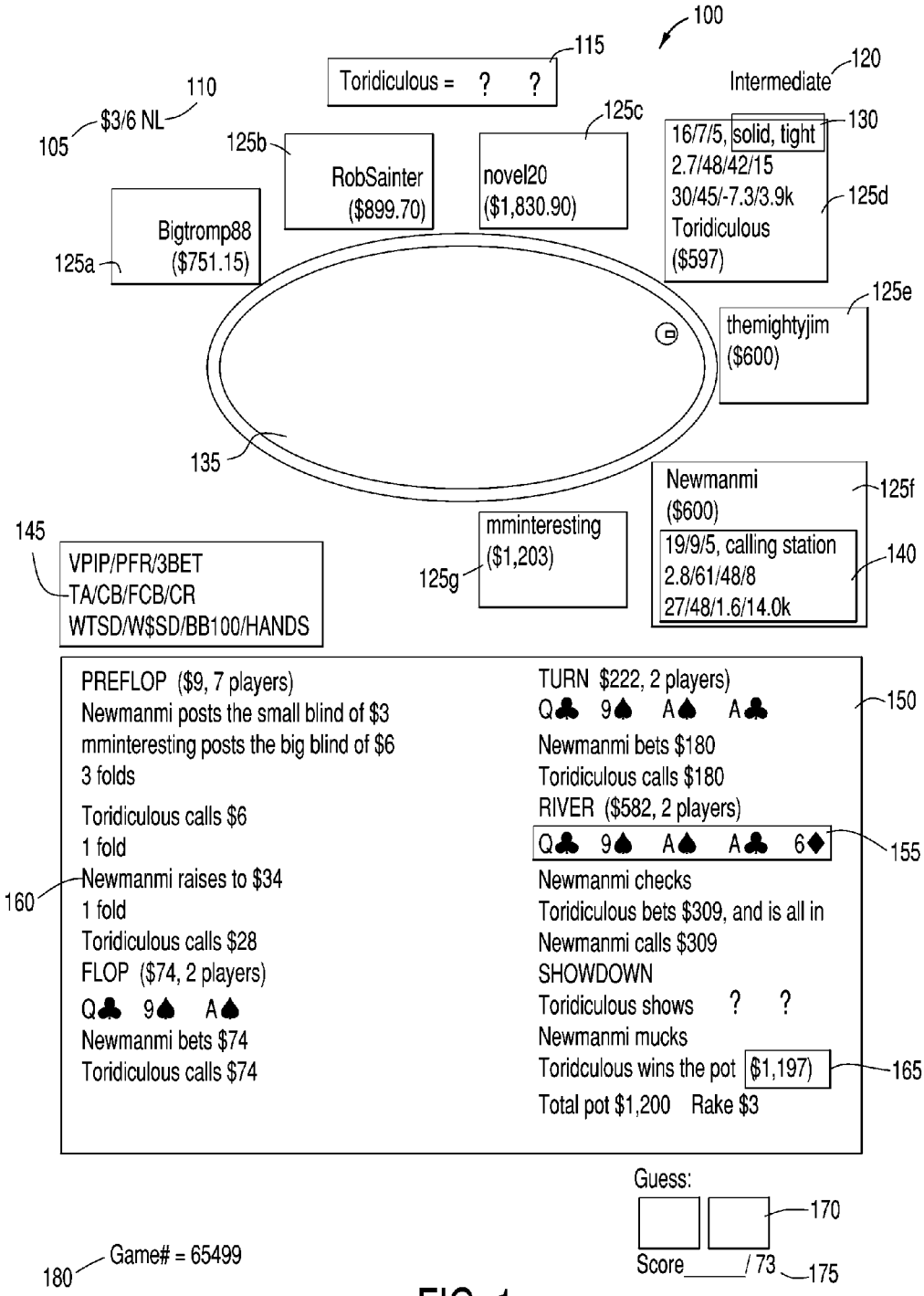
FIG. 1 is a representation of an exemplary deal of a poker hand, depicting the poker table, hypothetical players, and information pertaining to the players and the action.

The present invention may be implemented firstly, as a method of establishing a puzzle to be solved by a person acting as a puzzle solver, wherein the method of establishing a puzzle involves an evaluation of novel parameters that govern the nature of a puzzle, and secondly, as an exercise or game based on established puzzles wherein a puzzle to be solved is the nature of concealed card holdings in a card game of plural players wherein at least one card of a holding of one player is concealed from the puzzle solver.

An advantageous application of the invention is the field of poker, and in particular, forms of poker wherein players are dealt individual holdings which are concealed from other players. Players may also share a community holding. A community holding is a card or set of cards which are exposed to and shared by all players and which may be selected from for inclusion in forming card combinations together with any, all, or none of a player's concealed cards. As poker is most often played in conjunction with betting, the selected form of poker may include procedures such as rules permitting players to go all-in, bet any amount or an amount up to the amount of the current pot size, or bet a set limit amount. Examples of such games are seen in Texas Holdem and Omaha Holdem.

The first aspect of the invention to be discussed is a method of qualifying a deal, or manufacturing a deal, of a known or pre-established game such as one of the mentioned forms of poker in which the game consists of at least one concealed card holding of one of the players. The deal that is qualified or manufactured presents the basis for a puzzle to be solved, namely, the nature of one or more sets of concealed card holdings of players participating in the deal.

A deal of a poker hand has many elements which must be considered when attempting to qualify or manufacture a deal such that the deal would be useful for the above stated purposes and goals. The evaluated elements may be descriptive parameters of the deal under consideration or analyzed parameters of the deal under consideration.

The descriptive parameters of a poker deal comprise descriptive characteristics or aspects of the deal or of players or group of players included in the deal. Descriptive parameters include for example the specific deal type such as Texas Holdem, betting limits and rules, total number of players, summaries of past deals such as average pot size, characteristics of any or all of the community cards such as board textures, specific situations requiring player decisions on betting, and in some cases, drawing cards, and other descriptive characteristics of a poker deal. The descriptive parameters may be randomly selected or specifically set so that a game puzzle is created based on a deal which conforms to any or all of the above descriptive parameters.

In addition to considering descriptive parameters of a deal, values of specific puzzle parameters of a deal may be mathematically quantified. The quantified values of puzzle parameters may be compared to predetermined or calculated threshold values and the sum of all quantified values of puzzle parameters may be compared to a predetermined or calculated threshold value for consideration of the deal as achieving candidacy for inclusion as a puzzle which may be utilized for the exercise of guessing concealed cards.

TABLE 1

| | |
|---|---|
| Puzzle question | The question posed by the puzzle |
| Puzzle answer | The answer to the puzzle |
| Puzzle answer hand | The best poker hand available from any combination of puzzle answer cards and shared community cards |
| Puzzle answer hand rank | The best poker hand rank available from any combination of puzzle answer cards and shared community cards |
| Puzzle answer hand strength | A measure of how strong the puzzle answer hand is in relation to the full range of possible hands, and/or all or a subset of all possible hands |
| Puzzle answer rank strength | A measure of how strong the puzzle answer hand rank is in relation to the full range of possible hand ranks and/or all or a subset of all possible hand ranks |
| Puzzle answer card suit | The specific suit of a card included within the puzzle answer; this may include plural cards |
| Puzzle answer card number | The specific number or rank of a card of the puzzle answer; this may include plural cards |
| User guess | The input from the user to answer the puzzle question |
| User guess hand | The best poker hand available from any combination of the user guess cards with known community cards |
| User guess hand rank | The best poker hand rank available from any combination of user guess cards with known community cards |
| User guess hand strength | A measure of how strong the user guess hand is in relation to the full range of possible hands and/or all or a subset of all possible hands |
| User guess hand rank strength | A measure of how strong the user guess hand rank is in relation to the full range of possible hand ranks and/or all or a subset of all possible hand ranks |
| User guess score | A quantitative or qualitative analysis of a user guess |
| Possible hands | All possible hands available from any combination of all or a subset of possible player starting cards with known and/or possible community cards |
| Possible hand ranks | All possible poker hand ranks available from a combination of all or a subset of possible player starting cards with known and/or possible community cards |
| Possible starting hands | All possible non-suit specific groups of player starting hands |
| Possible starting cards | All distinct possible card combinations of player starting cards |
| Card suit criticality | The degree a given suit may be a factor in the overall poker hand |
| Card number criticality | The degree a given card number or rank may be a factor in the overall poker hand |
| Hand rank probability | A measure of how probable a random guess would result in the correct puzzle hand rank |
| Hand probability | A measure of how probable a random guess would result in the correct puzzle hand |
| Starting hand probability | A measure of how probable a random guess would result in the correct puzzle answer hand |
| Card suit probability | A measure of how probable a random guess would result in the correct puzzle answer card suit |
| Card number probability | A measure of how probable a random guess would result in the correct puzzle answer card number |

DEFINITIONS

The puzzle parameters are defined in the following ways:

The quantity of actions refers to the sum of actions taken by a player or group of players in a real, virtual, or manufactured deal such as folding, betting, calling, raising, check-raising, and the like. The quantity of actions may also be represented as the ratio of the sum of actions taken by a player or group of players to the number of distinct players or group of players with actions.

The total quantity of actions for a deal or for a portion of a deal may be set to meet or not exceed predetermined threshold values. Similarly, the quantity of actions for a particular street or group of streets or number of players or group of players may be set to meet or not exceed predetermined threshold values.

Further, the number of players or group of players and the number of streets or group of streets with a minimum or maximum quantity of actions may be set to meet or not exceed predetermined threshold values. The predetermined threshold values may be set for each parameter, or alternatively, may be established in light of resultant values of any puzzle parameter or combination of parameters.

In addition to calculating the quantity of actions, in which all actions are treated equally, the quality of actions quantifies the overall action of a deal by assigning weights to each action based on the strength of the particular action, relation of the particular action to previous or other actions, relation of the particular action to the strength of a player's hand, relation of the particular action to any relevant statistical and non-statistical information, and progression of action in the deal. Illustratively, a particular action may be given greater or lesser weight than a different action, or similar action in a different deal or that occurred in a different game situation. The weight of an action may be static, or alternatively, may dynamically increase or decrease as game action progresses. This mirrors the reality that subsequent actions by any player may increase or decrease the significance of a prior action.

The quality of actions refers to the sum of weighted actions taken by a player or group of players in a real, virtual, or manufactured deal. The quality of actions may also be represented as the average of all, or a subset of all, weighted actions taken by a player or group of players. Further, the quality of actions may also be represented by the ratio of the sum or average of all, or a subset of all, weighted actions to the number of distinct players or group of players or street or group of streets with actions.

The total quality of actions for a deal or for a portion of a deal may be set to meet or not exceed predetermined threshold values. Similarly, the quality of actions for a particular street or group of streets, number of players or group of players, action type, or combination of action types may be set to meet or not exceed predetermined threshold values.

The number of players or group of players, number of streets or group of streets, number of actions or group of actions, and number of distinct action types or group of action types with a minimum or maximum quality of actions may be set to meet or not exceed predetermined threshold values. The predetermined threshold values may be set for each parameter, or alternatively, may be established in light of resultant values any puzzle parameter or combination of parameters.

Statistical information pertaining to the deal and players in the deal may assist the puzzle solver in making a more educated guess as to the identity of the concealed cards. The statistical information may be data on historical play of players in the deal, such that the data provides a history of how a player has acted in previous situations over a number of prior deals, or alternatively, the statistical information may be data on the current deal, such that the data provides mathematical probabilities of probable deal outcomes.

The quantity of statistical information refers to the sum of known statistical data points. For inclusion as a statistical data point, a confidence level for each statistical data point may be set to meet or not exceed predetermined threshold values.

The quantity of statistical information for a deal or for a portion of a deal, or for each action, type of action, combination of action types, street or group of streets, player or group of players, and combinations thereof may be set to meet or not exceed predetermined thresholds.

The ratio of quantity of statistical information to the number of players or group of players, quantity of actions, and quality of actions may be set to meet or not exceed predetermined threshold values.

The number of players or group of players, number of streets or group of streets, number of actions or group of actions, and number of distinct action types or group of action types with a minimum or maximum quantity of statistical information or with a minimum or maximum average quantity of statistical information, or any combination of these, may be set to meet or not exceed predetermined threshold values.

Each statistical data point may be exploited to assist a person solving the puzzle. The degree to which a known statistical data point assists the user may be quantified to arrive at an individual quality of statistic. For each statistical data point, the quality of statistic equates to the degree by which a player's individual statistic varies from that of a calculated average, such that a variance from the calculated average either narrows or broadens the range of possible concealed card holdings. The calculated average may be for all players across many deals or across a select set of deals. These deals may be grouped by game type, game limit, date range, number of players, player personalities or types, action types, and combinations thereof. Further, a quality of statistic may be adjusted for example by weighting factors which acknowledge disproportionality of importance or relevance to a particular game situation. The values of the statistical weighting factors may be static or may dynamically change in response to ongoing evolution of the deal.

The quality of statistical information equates to the sum of all, or a subset of all, weighted and mathematically normalized quality of statistics of the deal or of all players, or a subset of all players, of the deal. The quality of statistical information may also be represented by the average of all, or a subset of all, weighted and normalized quality of statistics. The quality of statistical information for a deal or for a portion of a deal, or for each action, type of action, combination of action types, street or group of streets, player or group of players, and combinations thereof may be set to meet or not exceed predetermined threshold values.

The ratio of the quality of statistical information to the number of players or group of players, quantity of actions, quality of actions, and quantity of statistical information may be set to meet or not exceed predetermined threshold values.

The number of players or group of players, number of streets or group of streets, number of actions or group of actions, and number of distinct action types or group of distinct action types a minimum or maximum quality of statistical information, or any combination of these, may be set to meet or not exceed predetermined threshold values.

In addition to statistical information, there exists non-statistical information of a deal or of players of a deal that may assist the puzzle solver in solving a given puzzle. The non-statistical information may include player name, size of player's bank roll, player's background such as years playing poker or education level, summarized player's playing style such as big bluffer or solid player, player's winning or losing history such as 3-time World Series of Poker gold-bracelet winner, player's physical actions such as hands shaking or leaning forward, player's emotional state such as on tilt or happy, general player information such as gender or age, specific hand information such as equity in pot, and full or partial results of a deal.

The quantity of non-statistical data equates to the sum of known additional pieces of information. The quantity of non-statistical information for the deal, or for a portion of the deal, or for each action, type of action, combination of action types, street or group of streets, player or group of players, and combinations thereof may be set to meet or not exceed predetermined threshold values.

The ratio of quantity of non-statistical information to the number of players or groups of players, quantity of actions, and quality of actions may be set to meet or not exceed predetermined threshold values.

The number of players or group of players, number of streets or group of streets, number of actions or group of actions, and number of distinct action types or group of distinct action types with a minimum or maximum quantity of non-statistical information or with a minimum or maximum average quantity of non-statistical information, or any combination of these, may be set to meet or not exceed predetermined threshold values.

Each non-statistical piece of information within the total quantity of non-statistical information may be exploited to by the puzzle solver to help him or her solve a given puzzle. The degree by which a known non-statistical piece of information assists the user may be quantified to arrive at an individual quality of a non-statistical piece of information. The quality of each non-statistical piece of information may be adjusted for example by weighting factors which acknowledge disproportionality of importance or relevance of the particular piece information to a particular game situation. The values of the non-statistical weighting factors may be static or may dynamically change in response to ongoing evolution of the deal.

The total quality of non-statistical information equates to the sum of all, or a subset of all, weighted and mathematically normalized qualities of non-statistical pieces of information of the deal or of all players, or a subset of all players, of the deal. The quality of non-statistical information may also be represented by the average of all, or a subset of all, weighted qualities of non-statistical pieces of information. The quality of non-statistical information for a deal or for a portion of a deal, or for each action, type of action, combination of action types, street or group of streets, player or group of players, and combinations thereof may be set to meet or not exceed predetermined threshold values.

The ratio of the quality of non-statistical information to the number of players or group of players, quantity of actions, quality of actions, and quantity of non-statistical information may be set to meet or not exceed predetermined threshold values.

The number of players or group of players, number of streets or group of streets, number of actions or group of actions, and number of distinct action types or group of distinct action types with a minimum or maximum quality of non-statistical information, or any combination of these, may be set to meet or not exceed predetermined threshold values.

Additional puzzle parameters quantified to assess whether or not a deal is suitable for inclusion as a game puzzle include the quantity of distinct hand rank possibilities, the quantity of distinct hand possibilities, the quantity of distinct potential hand rank possibilities, and the quantity of distinct potential hand possibilities.

A hand rank possibility refers to a possible five-card hand rank such as pair, two pair, straight, flush, full house, and the like, calculated by combining any possible combination of known board cards with any combination of possible player starting cards. The quantity of hand rank possibilities equates to the sum of distinct hand rank possibilities across all possible combinations of known board cards with all combinations of possible player starting cards for a particular deal. The quantity of hand rank possibilities may be set to meet or not exceed predetermined threshold values at showdown or at any point in the deal prior to showdown.

A hand possibility refers to a possible five-card hand such as seven-high straight, eight-high straight, nine-high straight, and the like, within the hand rank of straight, calculated by combining any possible combination of known board cards with any combination of possible player starting cards. The quantity of hand possibilities equates to the sum of distinct hand possibilities across all possible combinations of known board cards with all combinations of possible player starting cards for a particular deal or for a particular hand rank within a particular deal. The quantity of hand possibilities may be set to meet or not exceed predetermined threshold values at showdown or at any point in the deal prior to showdown.

A potential hand rank possibility refers to a possible five-card hand rank such as pair, two pair, straight, flush, full house, and the like, calculated by combining any possible combination of known board cards and an available additional card with any combination of possible player starting cards. The quantity of potential hand rank possibilities equates to the sum of distinct potential hand rank possibilities across all possible combinations of known board cards and an available additional card with all combinations of possible player starting cards for a particular deal. The quantity of potential hand rank possibilities may be set to meet or not exceed predetermined threshold values at showdown or at any point in the deal prior to showdown.

A potential hand possibility refers to a possible five-card hand such as seven-high straight, eight-high straight, nine-high straight, and the like, within the hand rank of straight, calculated by combining any possible combination of known board cards and an available additional card with any combination of possible player starting cards. The quantity of potential hand possibilities equates to the sum of distinct potential hand possibilities across all possible combinations of known board cards and an available additional card with all combinations of possible player starting cards for a particular deal or for a particular potential hand rank within a particular deal. The quantity of potential hand possibilities may be set to meet or not exceed predetermined threshold values at showdown or any point in the deal prior to showdown.

Another key puzzle parameter is the quantity of known or exposed cards. A player may expose his or her card or cards at showdown or at a point prior to showdown, or a card may be exposed by other means, such as a dealer misdeal. The quantity of known or exposed cards may be set to meet or not exceed predetermined threshold values.

The pot size, as it applies to the sum of individual bets which have been made to the current point of progress in a deal, is another key puzzle parameter considered in qualifying a deal for inclusion as a game puzzle. The pot size may also be represented as a ratio of the pot size to the table limit, quantity of action, or quality of action. The pot size for the deal or for a portion of the deal, or for each action, action type or combination of action types, street or group of streets, and combinations thereof may be set to meet or not exceed set predetermined threshold values.

All-in is a situation in which there is no more possible action due to a player or players having no remaining chips to bet. The street all-in refers to the street, or point in the deal, in which there is no more possible action due to all remaining players in the deal being all-in or no more than one remaining player in the deal not all-in. The street all-in may be set to meet or not exceed predetermined threshold values.

An action consistency is a measure of how consistent a player's action is in accordance with his or her playing style, relative hand strength, relevant statistical and non-statistical information, and resultant values of quantified puzzle parameters. Illustratively, an aggressive player with a strong hand at a point in the deal that acts weak at that same point in the deal receives a low action consistency score for that particular action within that particular deal. An action consistency may be weighted by the quality of that particular action. A player's action consistency equates to the average action consistency across all actions or a subset of all actions for that particular player in that particular deal or across many deals, or may be represented by the minimum or maximum action consistency for a particular player in that particular deal.

The action consistency for all players or a subset of players or group of players in the deal may be set to meet or not exceed a predetermined threshold value.

The number of players or group of players, number of streets or group of streets, number of actions or group of actions, and number of distinct action types with a minimum or maximum action consistency, or any combination of these, may be set to meet or not exceed predetermined threshold values.

The threshold values for each of the puzzle parameters may be predetermined for each parameter, and may be adjusted in light of results from evaluations of any combination of puzzle parameters. That is, for example if a resultant value to a puzzle parameter exceeds the required predetermined threshold, the predetermined threshold values for other puzzle parameters may be adjusted in light of the initial qualifying result. Further, the predetermined threshold values for puzzle parameters may dynamically change in response to the ongoing evolution of the deal and evaluation of the deal.

The total sum of the resultant values of all puzzle parameters, or a subset of all puzzle parameters, may be set to meet or not exceed predetermined threshold values. In calculating the total sum of puzzle parameter values, each puzzle parameter value may be individually weighted and mathematically normalized to balance the relative importance of each parameter in the overall qualification of a deal for inclusion as a game puzzle.

Once a suitable deal is qualified by meeting the descriptive parameters and by meeting or not exceeding the threshold values of individual puzzle parameters and the sum of all weighted and normalized puzzle parameters, then a game puzzle or exercise predicated on the qualified deal may be generated. The generation of a game puzzle requires the concealing of player's card or cards that have been revealed during the deal and establishing those cards as those to be guessed in solving the puzzle. Further, the generation of a game puzzle requires identification of which elements within the puzzle parameters may be initially displayed to a puzzle solver, and which elements within the puzzle parameters may be withheld from a puzzle solver or made available in later stages of the game, such as with the use possible hints. The difficulty of the game puzzle may be calculated based on the resultant values of evaluations of puzzle parameters and the overall quantity, quality, and consistency of information displayed to a puzzle solver.

Following the generation of a game puzzle, a score may be calculated, which equates to the sum of any, all, or a subset of the following weighted and normalized quantified score components:

The hand rank score measures the proximity of a puzzle solver's guessed five-card hand rank to the correct five-card hand rank. The hand rank score may be adjusted to account for the quantity and range of all, or a subset of all, possible hand ranks.

The hand score measures the proximity of a puzzle solver's guessed five-card hand to the correct five-card hand. The hand score may be adjusted to account for the quantity and range of possible hands across all, within each, or within a subset of possible hand ranks.

The starting hand score measures the proximity of a puzzle solver's guessed starting hand to the correct starting hand. The starting hand score may be adjusted to account for the quantity and range of possible player starting hands across all, within each, or within a subset of possible hand ranks and possible hands.

The card suit score measures the proximity of a puzzle solver's guessed card suit to the actual card suit for each guessed card. Similarly, the card denomination score measures the proximity of a puzzle solver's guessed card denomination or number to the correct card denomination for each guessed card.

For each guessed card, the card suit or card denomination may or may not be critical factors in determining the overall hand; therefore it is not always reasonable to expect that the puzzle solver accurately guess the specific card suit or card denomination in all puzzles. To properly account for the relative importance of the card suit and the card denomination, the card suit score and card denomination score may be adjusted by the degree by which the card suit and card denomination are factors in forming the final five-card hand rank and final five-card hand, the degree by which the card suit and card denomination are factors in forming the set of concealed cards, the degree by which the card suit and card denomination may have been factors during the evolution of deal play, and the relative importance of the card suits and card denominations of other concealed cards.

The score equates to the sum of the hand rank score, hand score, starting hand score, card suit score for each guessed card, and card denomination score for each guessed card. The component scores may be individually weighted to account for the probability of a random guess that would result in the correct solution to a score component. Additionally, a component score may be individually weighted to account for criticality of that component score parameter to the puzzle solution and may be mathematically normalized to the sum of the maximum of any or all component scores.

The sum of all weighted and normalized component scores may be additionally adjusted for any of a plurality of score adjustment factors. These factors may include puzzle difficulty, quantity of information displayed, relevance of information displayed, and time used by the puzzle solver to solve the puzzle.

The score may be weighted to account for strength, relevance, and consistency of information displayed. The strength, relevance, and consistency of information may be based on the quantity and quality of actions displayed, not displayed, or both; the quantity and quality of statistical information displayed, not displayed, or both; the quantity and quality of non-statistical information displayed, not displayed, or both; the range of possible hand rankings, possible hands, possible starting hands, possible starting card suits and card denominations that may be limited, restricted, or highlighted by the displayed information; and consistency of the above within and across the displayed information.

A score may be derived and revealed to the puzzle solver and other observers.

In summary, the present invention discloses a poker based puzzle and a method by which the poker based puzzle is created. The poker based puzzle may be based on previous card deals or specifically manufactured so that the puzzle conforms to the defined descriptive and quantified puzzle parameters. The created poker based puzzle therefore consists of having attributes associated to each puzzle parameter and attributes associated to the sum of all, or a subset of all, puzzle parameters.

Determination of a particular deal as qualifying as the basis for a puzzle may depend on establishing numerical threshold values for individual and grouped parameters. The established thresholds may be different for various types of games, game limits, degrees of difficulty of a puzzle, number of players, resultant values to evaluations of puzzle parameters, or any combination of these.

After determination of a qualified deal, the deal may be presented as a puzzle by concealing known cards and displaying deal and player information to the puzzle solver. At this point, the puzzle may be treated as a game or exercise in which a participant tries to guess the nature of the concealed card holdings of the presented deal.

In the actual play, information pertinent to the game may be displayed and received in any suitable way, such as by computers, wireless telephones and related devices such as personal digital assistants, over the internet, as software applications, by email, text messages, paper, or by any other suitable methods.

With the above in mind, an example of a round of poker play is represented in FIG. 1, which shows an illustrative arbitrarily selected prearranged game depicted in a display 100. The display 100 may take any convenient form, and is to be understood as being a graphic presentation only. Displayed as relevant to the game are blind information 105 and game description 110. The display 100 may also present questions for a user, who for the purposes of the present example may assume the position represented by a theoretical poker player who has been given a pseudonym "Toridiculous" seen as 125*d*, which user is represented at the hypothetical poker table 135. It will be seen that six additional hypothetical players are depicted, namely, "Bigtromp88" 125*a*, "Rob-Sainter" 125*b*, "Novel20" 125*c*, "Themightyjim" 125*e*, "Newmanmi" 125*f*, and "Mminteresting" 125*g*.

The display 100 also shows an established difficulty level 120, the level being judged as "intermediate" in the present example. Each player 125*a*, 125*b*, 125*c*, 125*d*, 125*e*, 125*f*, and 125*g* is shown as being associated with respective statistical information such as the statistical profile 140 shown for the player 125*f*. A key 145 may be provided for interpreting each player's statistical and non-statistical information. A graphics window 150 may summarize action of the present deal at the table 135, with player actions, exposed community cards 155, and pot size 165 shown. A window 170 for receiving an input, which is a guess intended to answer the issue identified by question marks in the graphics windows 115 and 150, in this example the issue requiring identification of the card holding of the player 125*d*, is to be filled in by the player or participant in solving the puzzle posed by the display 100. An algorithm driven calculation may arrive at a score applicable to the player's guess, and may be displayed in a window 175. The subject deal may be archived for future reference. To this end, the display may assign an identification number such as that labeled 180 in FIG. 1.

Figure 2:
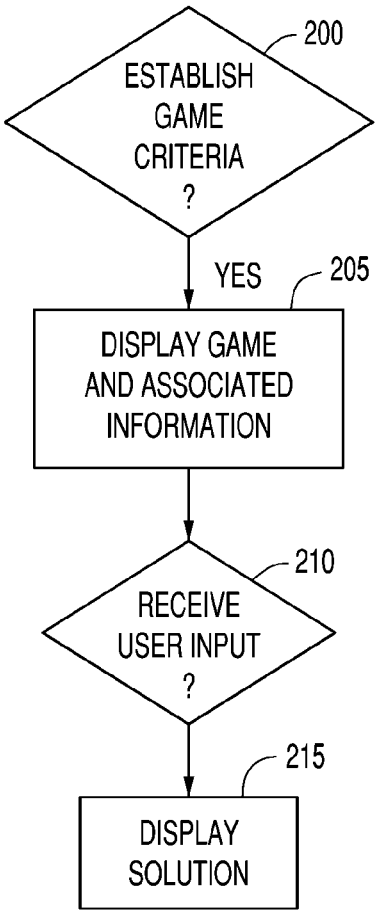
FIG. 2 is a logic diagram illustrating steps of a basic game generated according to the present invention.

The steps occurring in the above example are presented as a basic game in FIG. 2. In the first step 200, a user may provide game type criteria or randomly select game type criteria. The specific game and game characteristics are selected. In a step 205, the game and game information which follows from the selection made in the step 200 are displayed. The display may take any suitable form, such as a dedicated game apparatus (not shown), a web application, smart phone application, computer application, video, and the like. In a step 210, the player enters his or her input. In a step 215, the solution is displayed. The solution may be construed as being based on the answer to the question posed in the game display, such as the question posed in FIG. 1. Alternatively, the solution may include game score, training materials, tutorials, solution explanation, and thought or analysis processes. Constraints such as time allowed, betting amount constraints, and others may come into play.

Figure 3:
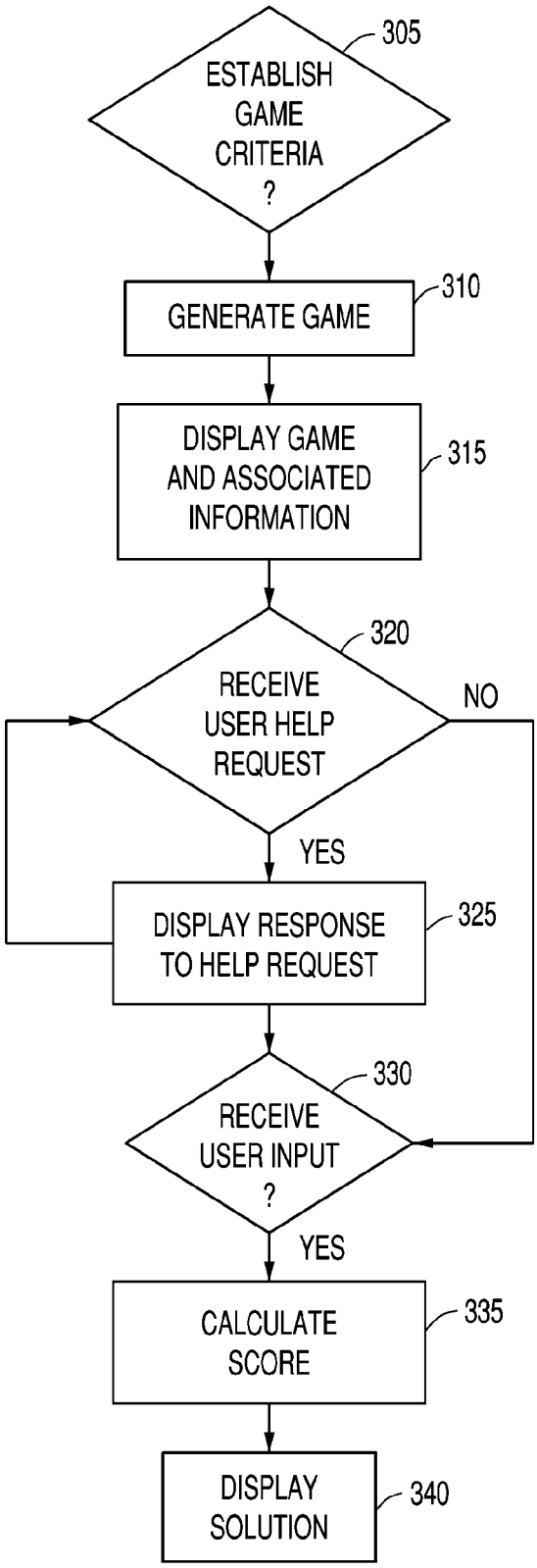
FIG. 3 is a logic diagram illustrating steps of a game amplified from that of FIG. 1.

Referring now to FIG. 3, in an amplified game, additional processes analyze game puzzles for additional criteria requirements and display results refined over those that would be presented in the game of FIG. 2. One of the newly presented features is that of the player requesting help via any of several options. Help responses may be displayed to the user.

In a step 305, establishment of game criteria is verified. In a step 310, the game is generated responsively to step 305. The selected game and associated information which is to be made available as background for the player are displayed in a step 315. The newly presented option for receiving help is seen as a step 320. If help is requested then available help in the way of appropriate information is displayed, seen as step 325. If no help has been requested at step 320, action moves to a step 330 wherein receipt of user input is verified. The user input is the user's guess in solving the puzzle that was presented as part of the step 315. The user's guess prompts a step 335 of calculating the score, which is followed by a step 340 of displaying the solution to the puzzle.

Figure 4:
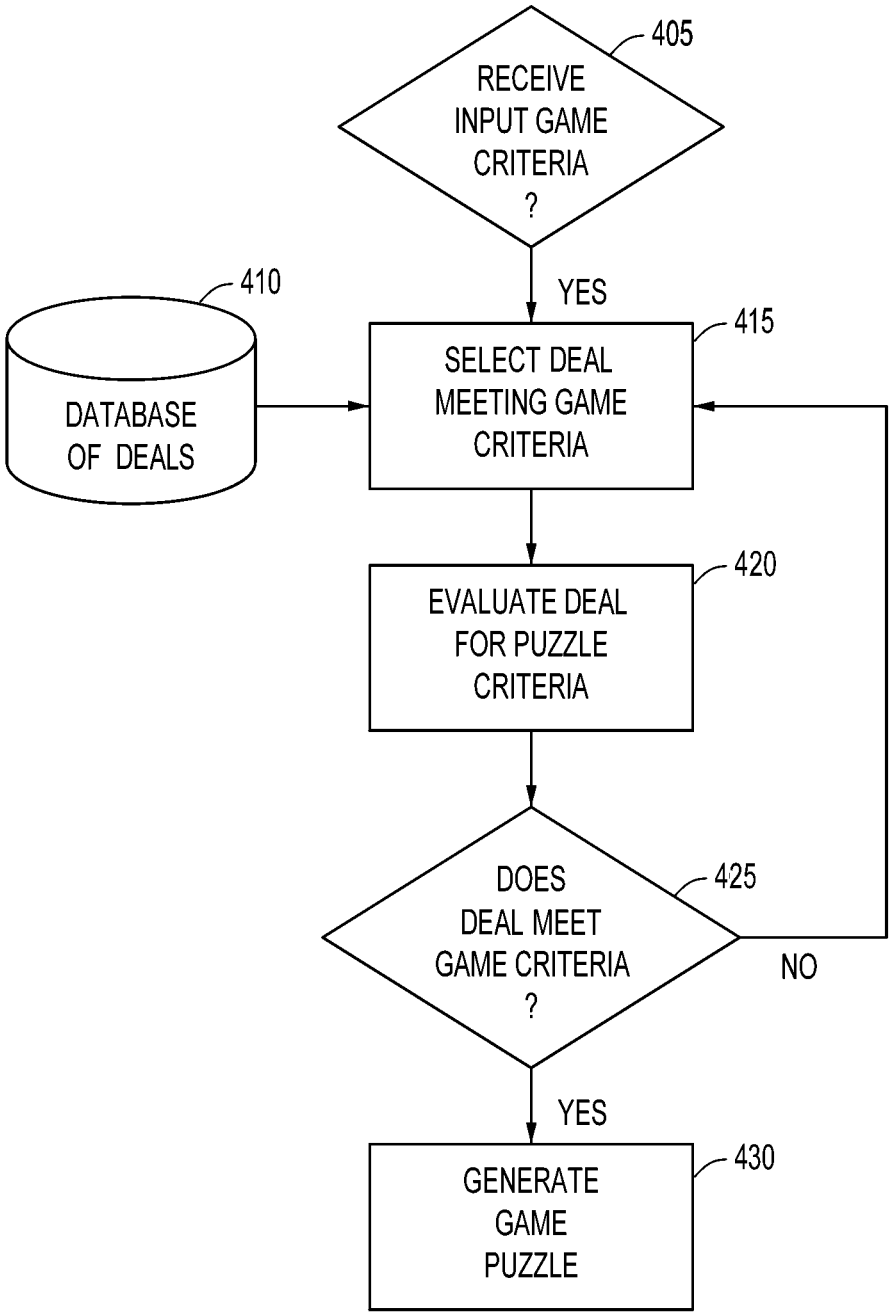
FIG. 4 is a logic diagram illustrating basic steps of a method of generating a puzzle according to at least one aspect of the invention.

FIG. 4 shows the basic steps of creating a puzzle which would for example satisfy the game displayed in step 205 of FIG. 2 or that displayed in step 315 of FIG. 3, noting that a game puzzle may comprise a single puzzle or alternatively a plurality of puzzles which may be aggregated to generate a game. The desired criteria are established so as to satisfy a step 405 which determines if the necessary input has been received. A database containing candidate deals may be consulted, this being seen as a step 410. Candidate deals may include those cards originally dealt to real or virtual players, as well as information pertaining to the actions taken by those players, background information such as tells and other personal attributes of the players, and other desirable background. Archived actual play, televised play, or even computer generated play may serve as source material for the database. After entry of desired game attributes from the step 405 and consideration of a candidate from the database, a hand is selected which meets the entered criteria of the step 405, this being seen as a step 415. In a step 420, the selected candidate is evaluated for meeting pre-established puzzle criteria. In a step 425, evaluation is judged as meeting or not meeting the game criteria. Failure to meet the game criteria routes the process back to the step 415 for selection of another candidate. Successful meeting of the game criteria in the step 425 leads to the step 430 of generating a game puzzle, which may then be presented for play.

Figure 5:
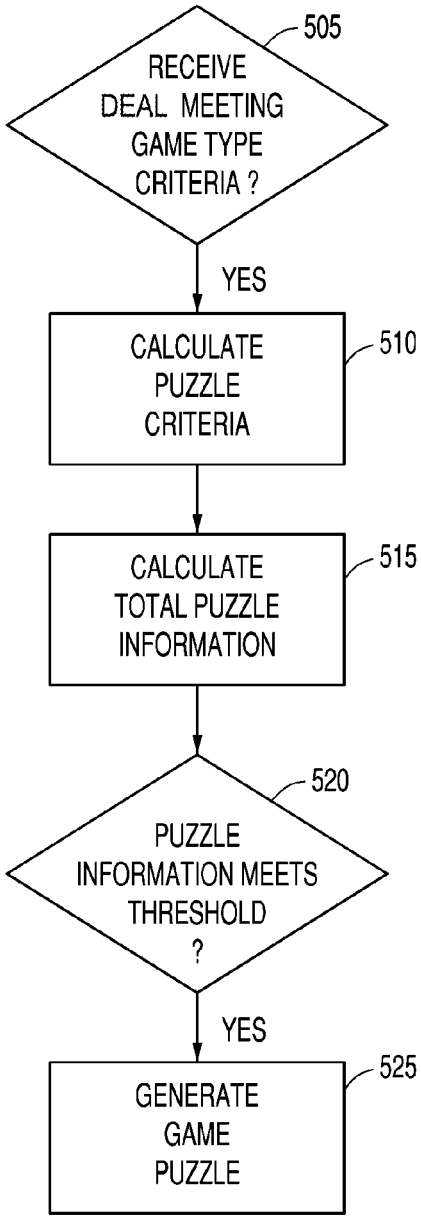
FIG. 5 is a logic diagram illustrating steps of evaluating a hand for compliance with puzzle criteria according to at least one aspect of the invention.

FIG. 5 shows steps of evaluating a deal for puzzle criteria. The process is initiated by a step 505 of verifying whether a hand meeting game type criteria has been entered or received. This is followed by a step 510 of calculating puzzle criteria and variations within each criterion for each hand. These criteria include quantity and quality of actions, quantity and quality of statistical information, quantity of hand possibilities and of potential hand possibilities, number of known cards, pot size, whether the street went all in, and quantity and quality of any additional information. The output of the step 510 is an inventory of all information that meets set thresholds for each puzzle criterion and variations thereof.

In a step 515, each puzzle criterion and possible variations are weighted. These weightings may be statically or dynamically defined based on hand, puzzle, or game information or criteria, or any combination of these. The total puzzle information may be stated as a sum of each constituent item within the inventory of all information that meets the established thresholds, multiplied by the weighting factors and normalizing factors, if the latter applies.

In a step 520, the puzzle information is assessed for meeting pre-established thresholds. These thresholds may establish minimum values, maximum values, or both. The thresholds which apply may reflect different game types, game limits, difficulty levels, numbers of players, and combinations thereof.

In a step 525, responsive to the assessment requirements of the step 520 being met, a game puzzle is generated.

Figure 6:
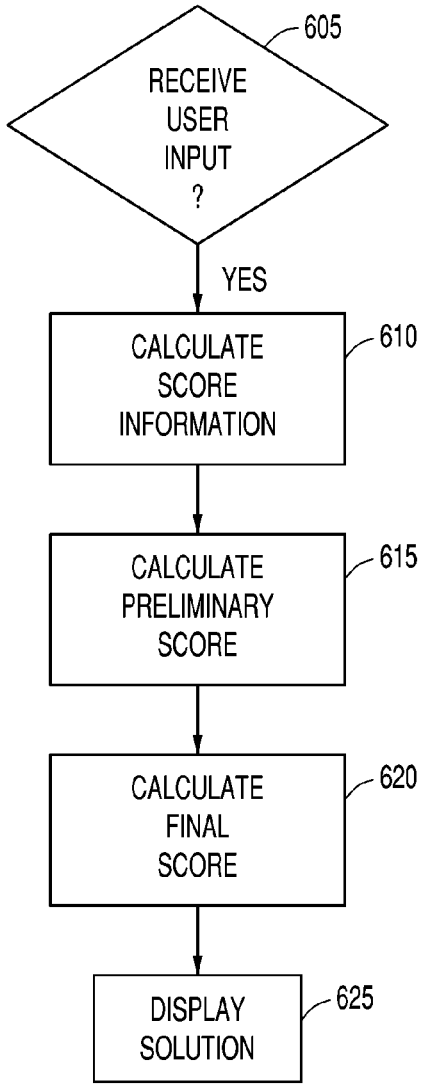
FIG. 6 is a logic diagram illustrating steps of calculating a score according to at least one aspect of the invention.

FIG. 6 shows steps of calculating a score, which may be based on an algorithm which considers at a minimum correct solution sets, nearness to correct solution sets, correctly guessing card identity or identities of plural cards, correct final five-card hands, number of made hand possibilities, number of potential hand outcomes, game difficulty, total amount of displayed or undisplayed relevance of game information, such as background information, use or declination of help requests, time required to solve the game or puzzle, and still other factors. The score may be calculated by a software application, by applying a formula, using a lookup table, or other ways.

In a step 605, action is initiated when a user input is received. In a step 610, score information is calculated. This encompasses the number, range, and probability for possible hand ranks, hands, starting hands, and starting cards, or combinations thereof. These are based on known community cards, other known cards, or both. The scoring system also calculates the probability that a random guess will arrive at the correct puzzle answer for any of the above characteristics.

From this, in a step 615 a preliminary score is calculated. The preliminary score may equal the sum of any of the considerations of hand rank score, a measure of the nearness of the user guess hand rank to the actual hand rank; hand score, a measure of nearness of the user guess starting hand to the actual starting hand; suite score, a measure of the nearness of the user guess card suit to the actual card suit for each user guess card, and number score, which is a measure of the nearness of the user guess card number to the actual card number for each user guess card. Each of these factors equals a normalized ratio of the nearness of the user guess hand rank, user guess hand, user guess starting hand, user guess card suit and/or card number to the correct puzzle answer hand rank, puzzle answer hand, puzzle answer starting hand, puzzle answer card suit and/or puzzle answer card number, to the full range or all of or a subset of all possible hand ranks, possible hands, possible starting hands, and possible starting card suits and numbers. Each of the above factors may be weighted to account for random guessing and for the criticality of the puzzle answer card suit or number. Each of the above factors may be weighted across all scores to account for relative importance of each score to the overall score. The above scores may be normalized to the sum of the maximum of all scores.

A step 620 of calculating a final score follows. Many factors may be added to the preliminary score to arrive at the final score, such as degree to which a card suit or card number, or both, are factors in forming a poker hand, forming a player starting hand, how the card suit or number or both played out during hand progression, and card suit or number criticality of additional cards. The total final score may adjust the preliminary score for puzzle difficulty, quantity and relevance of information displayed, and time required to solve the puzzle. The total preliminary score may be weighted to account for quantity and quality of actions, whether displayed or undisplayed, quantity and quality of statistical information, whether displayed or undisplayed, quantity and quality of additional information, whether displayed or undisplayed, range of possible hand ranks, possible hands, possible starting hands, possible starting card suits and numbers that may be limited, restricted, or highlighted by displayed or undisplayed information. Consistency of any aspects of the answer components may be factored in. The output of this step is a normalized weighting factor for each puzzle answer card suit and number to adjust the final user guess based on how critical the suits or numbers are to the overall poker hand. In a step 625, the solution is displayed.

I claim:

1. An apparatus for playing a poker puzzle game, comprising:

a computing device configured to have a memory function for storing information relating to attributes of a pre-established card game, wherein the game is a form of poker, and wherein the goal of the poker puzzle game is to have a player of the instructive game guess the nature of at least one concealed card holding from the pre-established card game;

a computing device configured to have a display device where said display device displays a reproduced portion of the pre-established card game to the player of the poker puzzle game, wherein a plurality of card game positions are held by number of card game players;

a computing device configured to conceal cards held by players of the pre-established card game;

a computing device configured to have a display device where said display device displays a question to be answered by the player playing the poker puzzle game;

a computing device configured to compute values for aspects of the pre-established card game and utilize the computed values to generate and control the poker puzzle game;

a computing device configured to receive help requests from the player of the poker puzzle game;

a computing device configured to generate output to the display device for the player of the poker puzzle game by revealing additional information per instructive game rules or as requested by the player of the poker puzzle game;

computing device configured receive inputs from the player of the poker puzzle game, wherein the input is a guess as to the nature of at least one concealed card holding of at least one player of the established game;

a computing device configured to have a display device where said device displays a solution of the poker puzzle game;

a computing device configured to calculate a score for the player of the poker puzzle game based on attributed related to how close the guess is to the actual concealed card holding from the pre-established game; and, a computing device configured to have display device where said display device displays the calculated score to the player of the poker puzzle game.

2. The apparatus of claim 1, further comprising a computing device configured to have a display device where said display device displays background information pertaining to the pre-established card game along with the reproduced portion of the pre-established card game, wherein the background information includes attributes of the pre-established card game players or further attributes of the pre-established card game that are required so that the player of the poker puzzle game has sufficient information by which to draw repeatable conclusions as to the nature of the concealed card holdings.

3. The apparatus of claim 1, further comprising a computing device configured to compute values to aspects of the pre-established game; and a computing device configured to have a display device where said display device displays information based on said computed scoring values.

4. The apparatus of claim 1, further comprising a computing device configured to generate additional information pertinent to the poker puzzle game available to the player on an optional basis, wherein said additional information is displayed on said computing device configured display device.

5. The apparatus of claim 4, further comprising a computing device configured to compute adjustments to the awarded score based on whether the player of the poker puzzle game accepted or declined the option to obtain the additional information pertinent to the poker puzzle game.

6. The apparatus of claim 1, wherein said values for aspects of the pre-established card game further comprise:

a computing device configured to compute levels of difficulty for guessing the nature of at least one concealed card holding; and a computing device configured to adjust the awarded score to reflect said level of difficulty for guessing the nature of at least once concealed card holding associated with the pre-established card game.

7. The apparatus of claim 1, wherein said score awarded to the player of the poker puzzle game further comprises a computing device configured to transform game characteristics into relationships between the awarded score and the underlying game information, wherein the game characteristics include at least one of:

strength, relevance, and consistency of information displayed by the game apparatus, quantity and quality of game information displayed by the game apparatus, quantity and quality of statistical and non-statistical information pertaining to the poker puzzle game displayed by the game apparatus, and range of potential and probable poker puzzle game guesses.

* * * * *